US006359599B2

(12) United States Patent
Apostolos

(10) Patent No.: US 6,359,599 B2
(45) Date of Patent: Mar. 19, 2002

(54) SCANNING, CIRCULARLY POLARIZED VARIED IMPEDANCE TRANSMISSION LINE ANTENNA

(75) Inventor: John T. Apostolos, Merrimack, NH (US)

(73) Assignee: BAE Systems Information and Electronic Systems Integration INC, Nashua, NH (US)

( * ) Notice: Subject to any disclaimer, the term of this patent is extended or adjusted under 35 U.S.C. 154(b) by 0 days.

(21) Appl. No.: 09/871,139

(22) Filed: May 31, 2001

Related U.S. Application Data

(60) Provisional application No. 60/208,192, filed on May 31, 2000.

(51) Int. Cl.[7] ..... H01Q 1/36; H01Q 21/26

(52) U.S. Cl. ..... 343/895; 343/797; 343/795

(58) Field of Search ..... 343/895, 744, 343/795, 797, 700 MS, 846, 731, 742, 813; H01Q 1/36, 21/26

(56) References Cited

U.S. PATENT DOCUMENTS

| | | | | |
|---|---|---|---|---|
| 3,633,207 A | | 1/1972 | Ingerson et al. | 343/770 |
| 3,736,534 A | | 5/1973 | Chaffee | 333/31 R |
| 3,754,197 A | | 8/1973 | Cristal | 333/33 |
| 3,754,271 A | | 8/1973 | Epis | 343/756 |
| 3,849,745 A | | 11/1974 | Schellenberg et al. | 333/31 R |
| 4,010,474 A | | 3/1977 | Provencher | 343/814 |
| 4,293,858 A | | 10/1981 | Hockham | 343/731 |
| 4,786,914 A | | 11/1988 | Wu et al. | 343/909 |
| 4,804,965 A | | 2/1989 | Roederer | 343/700 MS |
| 5,144,319 A | | 9/1992 | Roberts | 342/372 |
| 5,521,610 A | * | 5/1996 | Rodal | 343/797 |
| 5,563,616 A | | 10/1996 | Dempsey et al. | 343/753 |
| 5,592,182 A | | 1/1997 | Yoa et al. | 343/742 |
| 5,592,185 A | | 1/1997 | Itabashi et al. | 343/794 |
| 5,754,143 A | | 5/1998 | Warnagiris et al. | 343/767 |
| 5,784,032 A | * | 7/1998 | Johnson et al. | 343/742 |
| 5,786,792 A | | 7/1998 | Bellus et al. | 343/770 |
| 5,790,080 A | | 8/1998 | Apostolos | 343/744 |
| 5,818,397 A | | 10/1998 | Yarsunas et al. | 343/797 |
| 5,936,587 A | | 8/1999 | Godilev et al. | 343/752 |
| 5,943,011 A | | 8/1999 | Acoraci et al. | 342/373 |
| 5,949,303 A | | 9/1999 | Arvidsson et al. | 333/136 |
| 6,008,762 A | | 12/1999 | Nghiem | 343/700 MS |
| 6,025,812 A | | 2/2000 | Gabriel et al. | 343/797 |
| 6,034,637 A | | 3/2000 | McCoy et al. | 343/700 MS |
| 6,094,170 A | | 7/2000 | Peng | 343/700 MS |
| 6,104,348 A | | 8/2000 | Karlsson et al. | 343/700 MS |

OTHER PUBLICATIONS

PCT International Search Report dated Sep. 18, 2001 of International Application No. PCT/US00/33514 filed May 31, 2001.

* cited by examiner

*Primary Examiner*—Hoanganh Le
(74) *Attorney, Agent, or Firm*—Scott M. Asmus; Vernon C. Maine

(57) ABSTRACT

The present invention features a cross-element, steerable, scanning meander line loaded (MLA) antenna with circular polarization. The transmission lines comprise a plurality of alternating or stepped impedance sections with the high impedance elements acting as active antenna elements. The impedance varies depending upon the spacing from the moveable ground plane. The orthogonal MLA elements allow the application of an in-phase and a 90° shifted signal, thus each linear array radiates a circularly polarized RF signal. Controlling the spacing between the ground plane and transmission line provides relative phase control between the active elements and thereby phased-array directional control of the antenna. Forming a two-dimensional array of these linear arrays, produces a compact, low-cost, scanning, phased-array antenna.

20 Claims, 9 Drawing Sheets

SCANNING, CIRCULARLY POLARIZED VARIED IMPEDANCE TRANSMISSION LINE ANTENNA

CROSS REFERENCE TO RELATED APPLICATIONS

Applicant hereby claims the priority benefits in accordance with the provisions of 35 U.S.C. §119, basing said claim on United States Provisional Patent Application Ser. No. 60/208,192, filed May 31, 2000. Pending patent application Ser. No. 09/844135 entitled SINGLE FEED, MULTI-ELEMENT ANTENNA filed Apr. 27, 2001 and pending US Patent Application entitled NARROW-BAND, SYMMETRIC, CROSSED, CIRCULARLY POLARIZED MEANDER LINE LOADED ANTENNA filed May 31, 2001 are incorporated by reference herein.

FIELD OF THE INVENTION

The invention pertains to meander line loaded antenna and, more particularly, to multi-element antennas and arrays of such antennas, and more specifically to a scanning phased array MLA with circular polarization.

BACKGROUND OF THE INVENTION

In the past, efficient antennas have typically required structures with minimum dimensions on the order of a quarter wavelength of the radiating frequency. These dimensions allow the antenna to be easily excited, and to operate at or near resonance. This limits the energy dissipated in resistive losses, and maximizes the transmitted energy. This type of antenna tends to be large in size at the resonant wavelength. Further, as frequency decreases, antenna dimensions increase in proportion.

In order to address the shortcomings of traditional antenna design and functionality, the meander line loaded antenna (MLA) was developed. One such antenna is disclosed in U.S. Pat. No. 5,790,080, entitled MEANDER LINE LOADED ANTENNA hereby incorporated by reference. One type of MLA described in this prior art patent was for two spaced-apart vertical conductors attached to a ground plane, and a horizontal conductor located across the top of the vertical conductors. The vertical and horizontal conductors are separated by gaps, one or both of which are bridged by meander lines.

Meander lines are designed to adjust the electrical length of the antenna. In addition, the design of the meander slow wave structure permits lengths of the meander line to be switched in or out of the circuit quickly with negligible loss. This is done in order to change the effective electrical length of the antenna. This switching is possible because the active switching devices are always located in the high impedance sections of the meander line. This keeps the current through the switching devices low resulting in very low dissipation losses in the switch, and high antenna efficiency.

The simple, basic MLA can be operated in a loop mode that provides a "figure eight" coverage pattern. Horizontal polarization loop mode, may be obtained when the antenna is operated at a frequency wherein the electrical length of the entire line, including the meander lines is a multiple of full wavelength. The antenna can also be operated in a vertically polarized monopole mode, by adjusting the electrical length to an odd multiple of a half wavelength at operating frequency. The meander lines can be tuned using electrical or mechanical switches to change the mode of operation at a given frequency, or to switch the frequency in a given mode.

The MLA allows the physical dimensions of antennas to be significantly reduced, while maintaining an electrical length that is still a multiple and radiating structures of a quarter wavelength. Meander line loaded antennas achieve the efficiency limit of the Chu-Harrington relationship although the antenna size is much less than a wavelength at the frequency of operation. Height reductions of 10 to 1 can be achieved with comparable gain over quarter wave monopole antennas. The existing MLA antennas are narrow band antennas. Although the switchable meander line allows the antennas to cover wider frequency bands, the instantaneous bandwidth is narrow.

The meander line loaded antenna, as well as antennas in general, have certain limitations when used in arrays. Currently, array antennas are very expensive because each antenna receives its own, separate signal. These signals, typically, are generated by using an external corporate feed network. These limitations are further magnified in the case of phased array antennas that achieve directional control by varying the phase of the transmission signal between different array elements, thus requiring phase control for each element.

DISCUSSIONS OF THE RELATED ART

The aforementioned U.S. Pat. No. 5,790,080 describes an antenna that includes one or more conductive elements that act as radiating antenna elements and a slow wave meander line that couples electrical signals between the conductive elements. The meander line has an effective electrical length that affects the electrical length and operating characteristics of the antenna. The electrical length and operating mode of the antenna is readily controlled.

U.S. Pat. No. 5,943,011 entitled ANTENNA ARRAY USING SIMPLIFIED BEAM FORMING NETWORK discloses an example of an antenna array, or multi-element antenna and the feed network used for steering signals transmitted or received through the array. The signals coupled to and from each antenna element are adjusted in phase by a network of radio frequency (RF) hybrid devices.

U.S. Pat. No. 5,144,319 entitled PLANAR SUBSTRATE FERRITE/DIODE PHASE SHIFTER FOR PHASED ARRAY APPLICATIONS is an example of a phase shifter that can be used for an individual antenna element within an array, and shows the use of this shifter for each antenna element of a phased array.

U.S. Pat. No. 4,010,474 entitled TWO DIMENSIONAL ARRAY ANTENNA discloses a phase control network for the elements of a two dimensional array.

U.S. Pat. No. 5,949,303 entitled MOV ABLE DIELECTRIC BODY FOR CONTROLLING PROPAGATION VELOCITY IN A FEED LINE discloses a single phase shifter for use with multiple array elements. As shown in FIG. 1, a feed conductor line includes a source input and multiple antenna element outputs. A moveable dielectric material located between the feed line, or the carrier plate thereof, and a ground plane, controls the propagation velocity of signals coupled through the feed line. In this manner a mechanical adjustment is made which determines the phasing of multiple antenna elements.

The prior art shows the level of complexity that is required for the use of multiple element antenna arrays. There are a number of difficulties relating to individual connections as well as problems relating to phase control. What is needed is a simplified coupling and phase control that enables multi-element antennas that are simple to manufacture and operate without sacrificing performance.

SUMMARY OF THE INVENTION

In accordance with the present invention there is provided a maneuverable, scanning, phased-array, meander line loaded antenna having circular polarization. Linear arrays or transmission lines of crossed MLA elements each allow the application of two feeds—a first signal feed and a 90° phase shifted signal feed. When properly connected, each linear array, therefore, can radiate a circularly polarized RF signal. A compact, low-cost, scanning phased array may be built by forming a symmetrical superstructure of these linear arrays. For high-frequency applications, the inventive antenna structure may be readily formed using printed circuit manufacturing techniques.

An array antenna is disclosed for an inexpensive, dual-feed, array antenna utilizing a stepped or varied impedance transmission line to provide an active antenna array. The stepped nature of the antenna elements create a varied impedance transmission line as those sections that are further from the ground plane have a greater impedance than those elements closer to the ground plane. The higher impedance sections function as individual active array elements for radiating or receiving. Variation of the spacing among the active elements controls the antenna gain pattern. And, the delay line characteristics of the meander line elements are used to control the phase relationship of the antenna elements.

The present invention simplifies the design and manufacture of a phased-array MLA having circular polarization. The inventive antenna has an easily controlled beam and pointing direction. The invention also reduces the complexity of phased-array control logic and reduces the fabrication cost for phased-array antennas, especially antennas where circular polarization is required.

One of the structural differences between the antenna of the present invention and that of the related art, is that the invention features an array of orthogonal meander lines, and a movable back plate. This creates a slow wave configuration, which provides the necessary phase shift, producing a circular, polarized, radiation pattern.

It is, therefore, an object of the invention to provide a crossed-element meander line loaded linear array having circular polarization capability. A further object is a bow-tie meander line loaded linear array having circular polarization.

It is another object of the invention to provide a scanning, phase-structured MLA operating in a circular polarization mode, and formed from linear arrays of orthogonal MLA elements.

One of the features of the invention is the formation of linear arrays of multiple crossed MLA elements that may then be arranged into a symmetrical array. A movable ground plane provides for frequency tuning of the elements. The symmetrical array so formed provides a scanning, maneuverable phased array. The structure of the crossed MLA elements as a plurality of interconnected transmission lines provides operation in a circularly polarized array.

It is a further object of the invention to provide a scanning, phase-structured MLA with a movable back plate that operates in a circular polarization mode.

It is an additional object of the invention to provide a scanning, phase-structured MLA operating in a circular polarization mode, and which is fabricated using printed circuit manufacturing techniques.

An object of the invention is a varied impedance transmission line antenna, comprising a ground plane with a transmission line disposed substantially parallel to and in close proximity to the ground plane, wherein the transmission line is a plurality of crossed meander line loaded elements each having an upper element and a lower element. A first conducting line is interconnecting the upper element of each of the crossed meander line loaded elements and a second conducting line is interconnecting the lower element of each of the crossed meander line loaded elements.

And, the crossed meander line loaded elements are connected in series by the first and second conducting line and form an alternating impedance pattern based upon a spacing from the ground plane, wherein the first and second conducting line is a low impedance section and the crossed meander line loaded elements are a high impedance section.

A further object is the varied impedance transmission line antenna, wherein the first conducting line is connected to a first signal feed and the second conducting line is connected to a second signal feed. And, also where the first and second signal feed are phase-shifted by 90 degrees to place the feeds in quadrature.

And yet another object is the varied impedance transmission line antenna, wherein a propagation constant is varied by changing the spacing. The spacing can be varied dynamically, substantially continuously, and periodically by moving the ground plane. The ground plane can be mechanically moved by means a stepper motor or a piezoelectric actuator. In addition, a dielectric material can be disposed between the plurality of crossed meander line loaded elements and the ground plane with an adjustable dielectric constant, such as ferroelectric material, and the dielectric constant is changeable by an applied electric field.

An object of the invention is a varied impedance transmission line antenna, comprising a ground plane with a transmission line disposed substantially parallel to and in close proximity to the ground plane, wherein the transmission line is a plurality of dual bow-tie meander line loaded elements with a first bow-tie element disposed orthogonal to a second bow-tie element. There is a first conducting line interconnecting the first bow-tie element of each of the dual bow-tie meander line loaded elements and a second conducting line interconnecting the second bow-tie element of each of the dual bow-tie meander line loaded elements. An aspect of the invention is includes where the bow-tie meander line loaded elements are connected in series by the first and second conducting line and form an alternating impedance pattern based upon a spacing from the ground plane. The first and second conducting line is a low impedance section and the bow-tie meander line loaded elements are a high impedance section. A further aspect of the invention is that the ground plane is moveable.

And, an additional object is the varied impedance transmission line antenna, wherein the first conducting line is connected to a first signal feed and the second conducting line is connected to a second signal feed.

An object of the invention is a varied impedance transmission line antenna array, comprising a ground plane with two or more transmission lines disposed substantially parallel to and in close proximity to the ground plane, wherein the transmission lines are a plurality of crossed meander line loaded elements each having a first element and a second element. There is a first conducting line interconnecting the first element of each of the crossed meander line loaded elements and a second conducting line interconnecting the second element of each of the crossed meander line loaded elements. In this configuration it is easy to form a two-dimensional array. And the first and second signal feed can be selectively applied to the plurality of crossed meander line loaded elements, whereby the antenna is steerable. Furthermore, the first and second signal feed can be selectively applied to the plurality of crossed meander line loaded elements, whereby an operating frequency of the phased-array antenna is scannable.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

Figure 1:
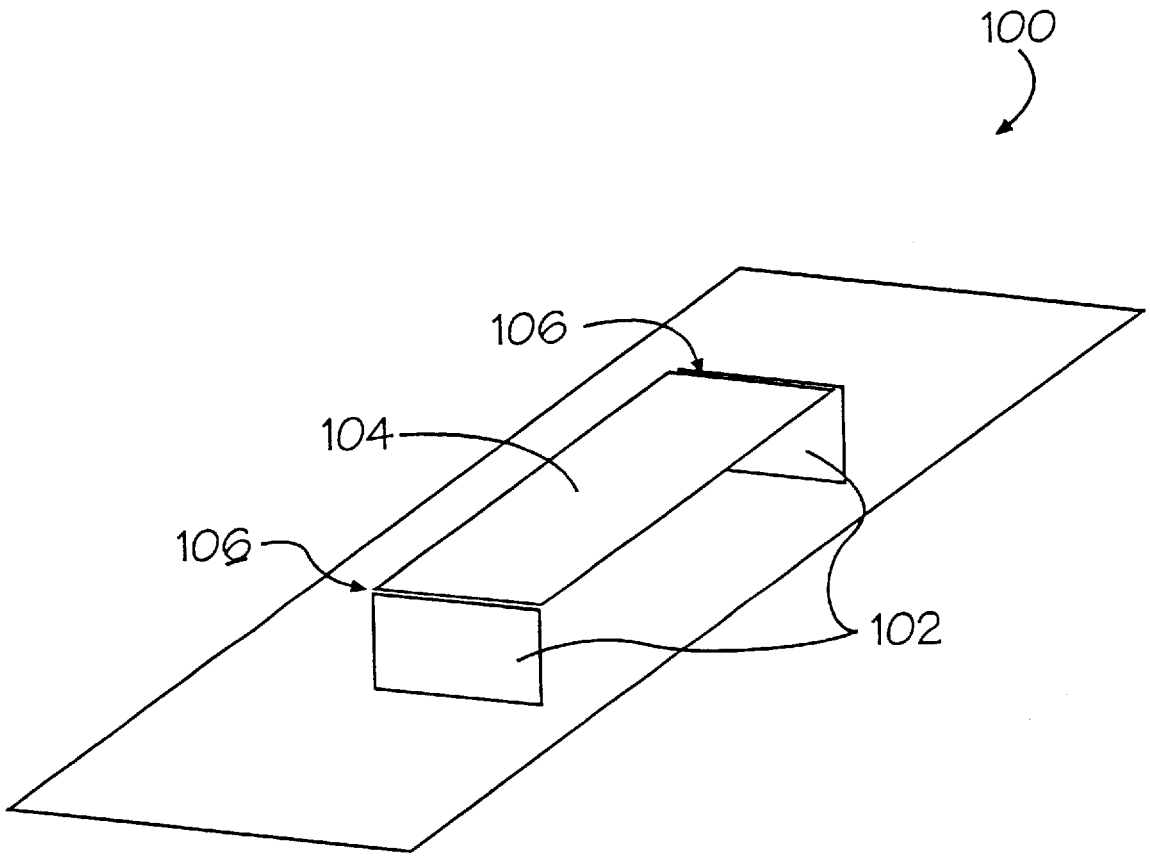
Prior Art Figure 1
FIG. 1 is a schematic, perspective view of a meander line loaded loop antenna of the prior art.

FIG. 1 illustrates the prior art meander line loaded structure 100 described in more detail is U.S. Pat. No. 5,790,080. A pair of opposing side units 102 are connected to a ground plane 105 and extend substantially orthogonal from the ground plane 105. A horizontal top cover 104 extends between the side pieces 102, but does not come in direct contact with the side units 102. Instead, there are gaps 106 separating the side pieces 102 from the top cover 104. A meander line loaded element 108, such as the one depicted in FIG. 2 is placed on the inner sides 102 or inner surface of the top cover 104 of the structure 100 such that the meander line 108 resides in the gaps 106.

Figure 2:
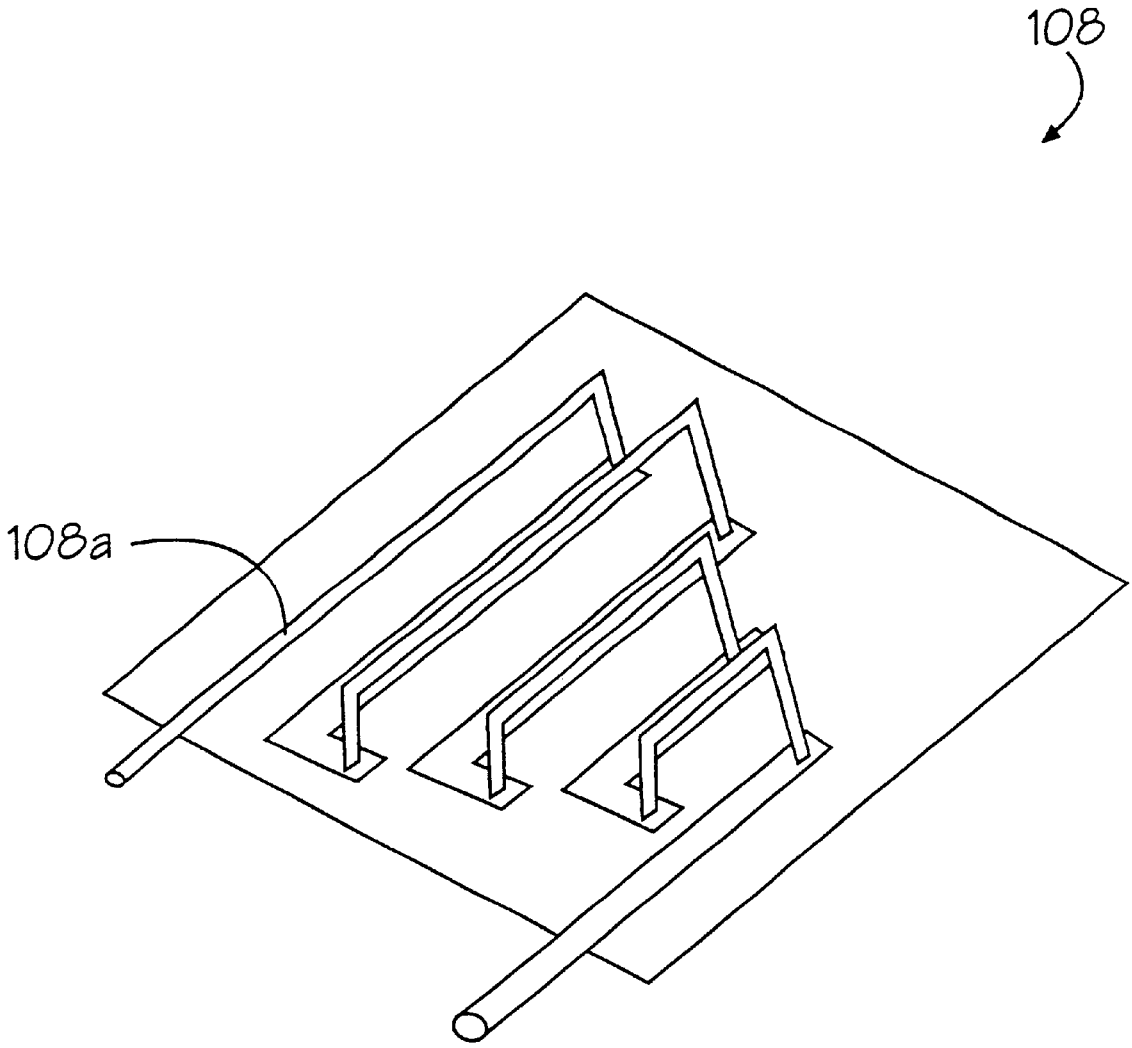
FIG. 2 is a schematic, perspective view of a meander line used as an element coupler in the meander line loaded loop antenna of FIG. 1.
Figure 3:
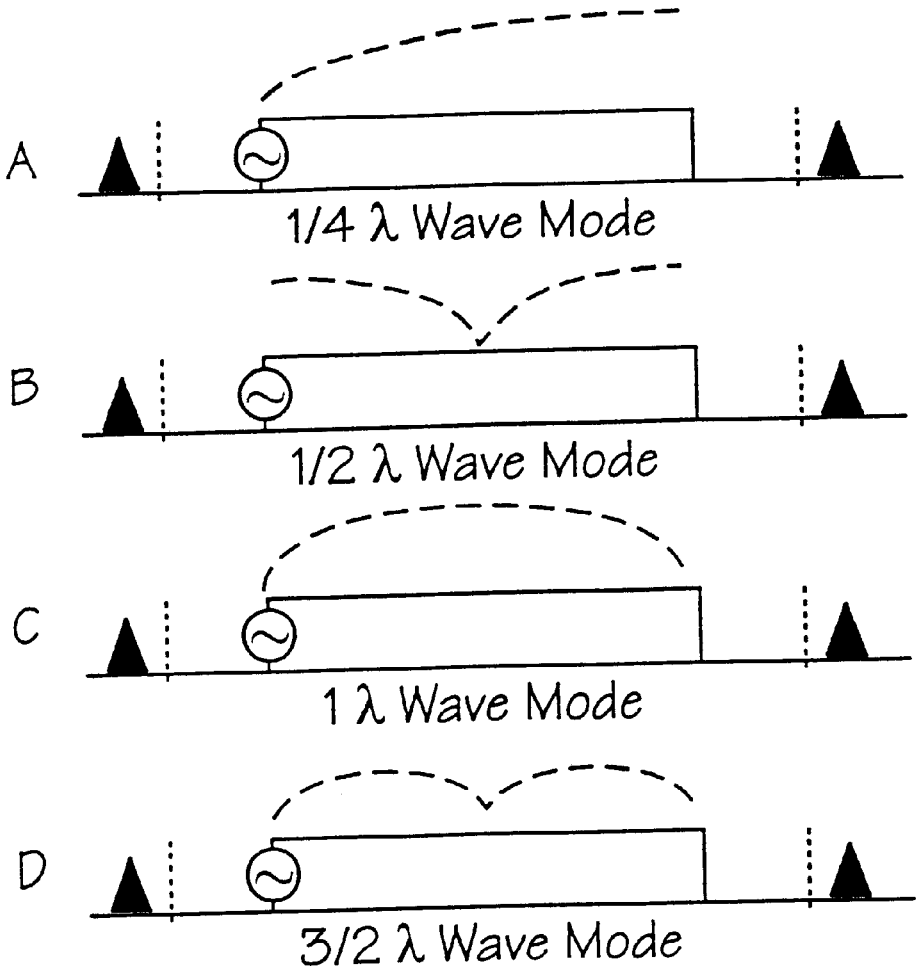
FIG. 3, consisting of a series of diagrams 3*a*–3*d* depicts four operating modes of the antenna of FIG. 1.

Referring now to FIG. 3, there are shown four typical operating modalities for the MLA 100 shown in FIG. 1 in combination with the meander line 108*a* (FIG. 2). Quarter wavelength ½, 1 and ⅜ modes of operation are shown. The meander line loaded structure 108 provides a switching means to change the electrical length of the line and thereby effect the properties of the structure 100. As explained in more detail in the prior art, the switching enables the structure to operate in loop mode or monopole mode by altering the electrical length and hence the wavelengths as shown in FIG. 3 A–D.

Figure 4:
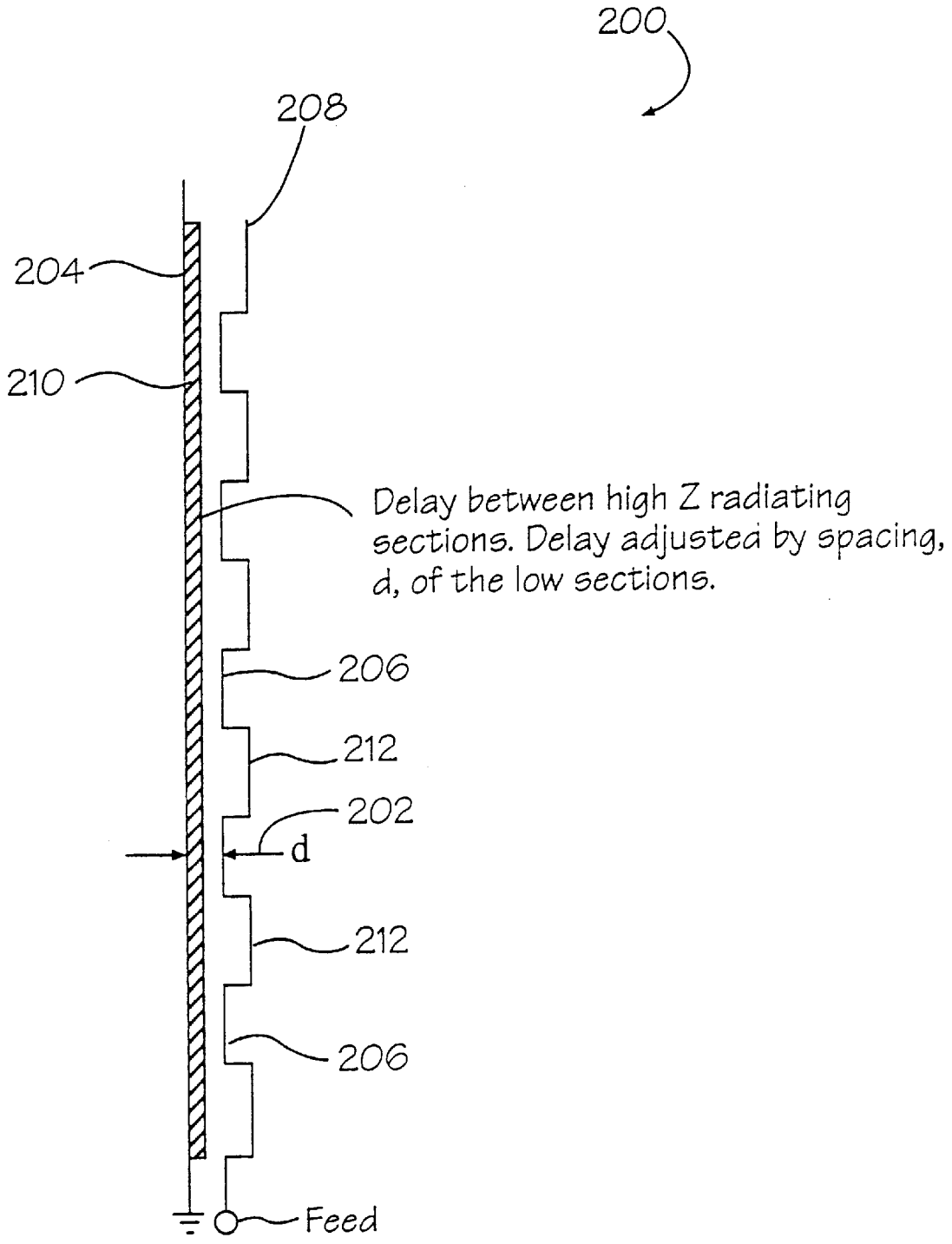
FIG. 4 is a schematic, cross-sectional view of a typical meander line having a movable ground plane.

Referring now to FIG. 4, there is shown a schematic, cross-sectional view of the meander line generally at reference number 200. The meander line 200 is a slow wave structure. By designing the transmission line to have regions at different impedance levels the propagation constant in the structure can be controlled and is given by:

$$\beta=\beta_0/2(Z_1Z_2)^{1/2}$$

where:

$\beta_0=2\pi/\lambda$ $Z_1$=high impedance $Z_2$=low impedance

The propagation velocity is thus dependent upon the ratio of alternating impedance values of the varied transmission line. There are many factors that contribute to the impedance values, including the size of the transmission lines, the dielectric constant of the dielectric, and the spacing between the transmission line and the ground plane. However once the other variables are static, the remaining adjustable variable is the spacing, which is used to effect the propagation constant. By controlling the propagation constant, the phase of the signal at each radiating element in a linear array can be controlled. This allows the construction of a low cost phased array with a fixed pointing direction.

One of the unique aspects of this invention is the nature of the stepped or varied impedance transmission line and the interaction with the moveable ground plane. The alternating spacing of the transmission line from the ground plane creates alternating impedance. Varying the spacing enables control of the antenna gain pattern. And, the delay line characteristics of the transmission line effect the phase relationship that is used to further influence and control the antenna.

In order to achieve an array that can be pointed and scanned, the propagation constant must be varied with time. This is achieved by changing the distance d 202 between a ground plane 204 and low impedance sections 206 of the meander line 208. Thus, the delay between the high Z radiating sections is adjusted by changing the spacing d 202 between the low Z sections 206 and the ground plane. The low Z sections are more dramatically affected by the movement of the ground plane as opposed to the high Z sections.

The mechanical motion of ground plane 204 can be accomplished by using stepper motors or piezoelectric motors (not shown) to drive a mechanical linkage to the ground plane. Alternatively, the space 202 between the ground plane 204 and the low impedance sections 206 of the meander line 208 can contain a ferroelectric material 210 with a dielectric constant that can be varied by applying an electric field (not shown). Both the implementation of the mechanical moving means and altering the dielectric constant are known to those skilled in the art.

Either of these actions (i.e., changing the distance between ground plane 204 and low impedance sections 202 of 20 meander line 206, and/or changing the dielectric constant of dielectric material 210 within the region between ground plane 204 and low impedance sections 206 of line 208) results in a change in the ratio of the high to the low impedance values. This change in impedance values in turn, changes the propagation constant and the phase shift experienced at each of the elements (i.e., high impedance sections 212).

Aspects of the present invention are also described in pending patent application Ser. No. 09/844135 entitled SINGLE FEED, MULTI-ELEMENT ANTENNA. This invention utilizes crossed MLA antennas to form a transmission line having circular polarization and uses a compressed pattern with two signal feeds.

Figure 5:
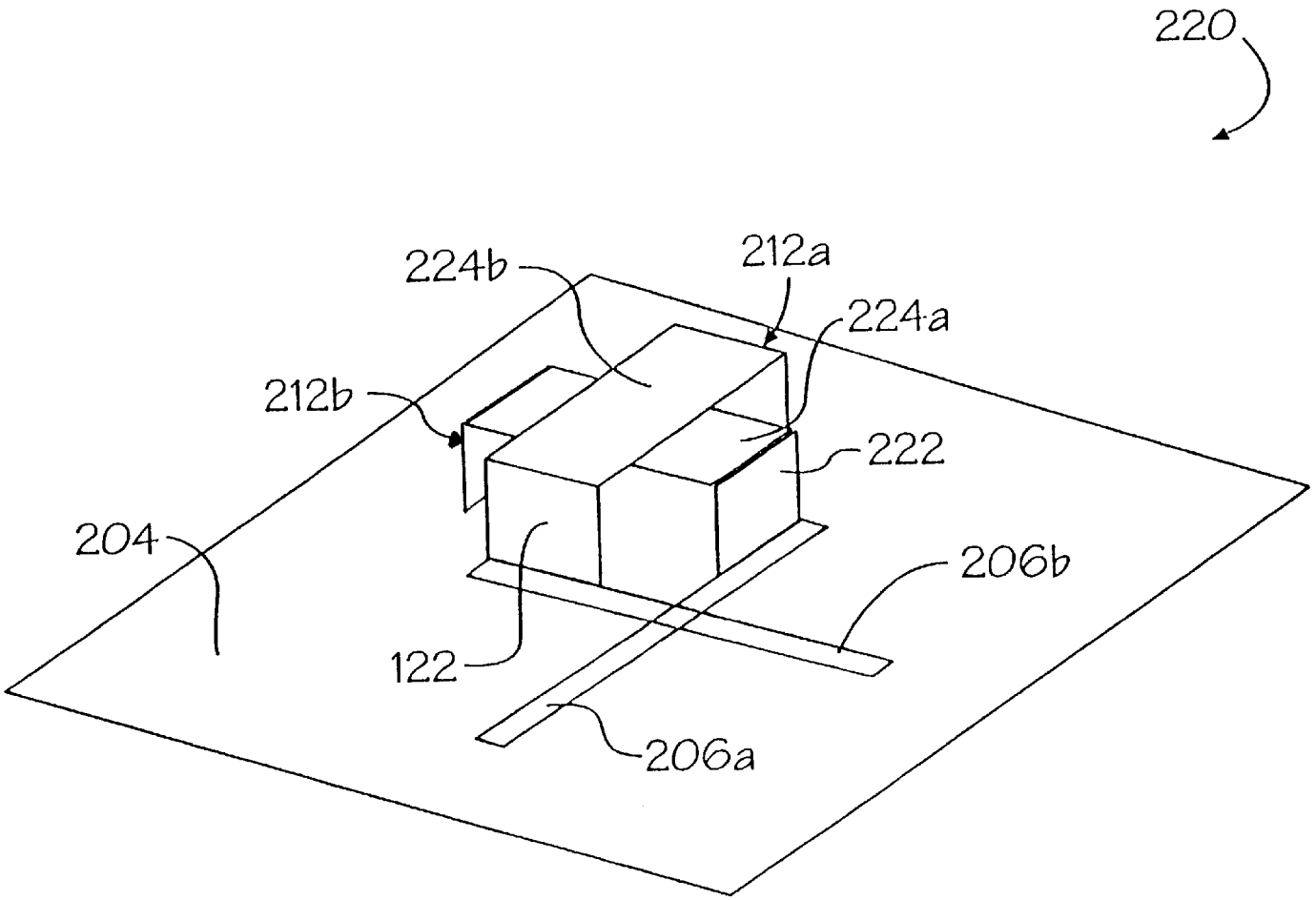
FIG. 5 is a schematic, perspective view of the single crossed MLA element.

Referring now to FIG. 5, there is shown a schematic, perspective view of a crossed MLA element, generally at reference number 220. Each MLA element 212*a*, 212*b* is a high impedance section 212 of meander line 208 (FIG. 4), and they have traditional loop construction. Upper crossed element 212*a* consists of two vertical radiating surfaces 122 separated from a horizontal surface 224*b* by gaps (not shown).

Lower crossed element 212*b* consists of two vertical radiating surfaces 222 separated from a horizontal surface 224*a* by gaps (not shown). These antenna elements represent the high impedance portion of two distinct meander lines. This configuration, when properly fed in quadrature as is known in the art, is capable of producing a circularly polarized signal.

Each MLA element 212*a*, 212*b* is connected to a low-impedance section 206*a*, 206*b* corresponding to low-impedance section 206 of meander line 208 (FIG. 4). These low impedance portions of the meander lines 206*a*, 206*b* connect to the next element in the linear array. The overlapping low impedance portions 206*a* and 206*b* are not electrically connected at the junction point, thus isolating the two signal feeds as they traverse the transmission line.

Multiple linear arrays may be interconnected and arranged to form a square or rectangle as shown herein, as well as other shapes in conformance with the principles of the present invention. This configuration, when properly fed, is capable of producing a circularly polarized signal for the array structure. In one embodiment the low impedance sections are striplines, such as copper, that interconnects the sequential orthogonal antenna sections.

Figure 6:
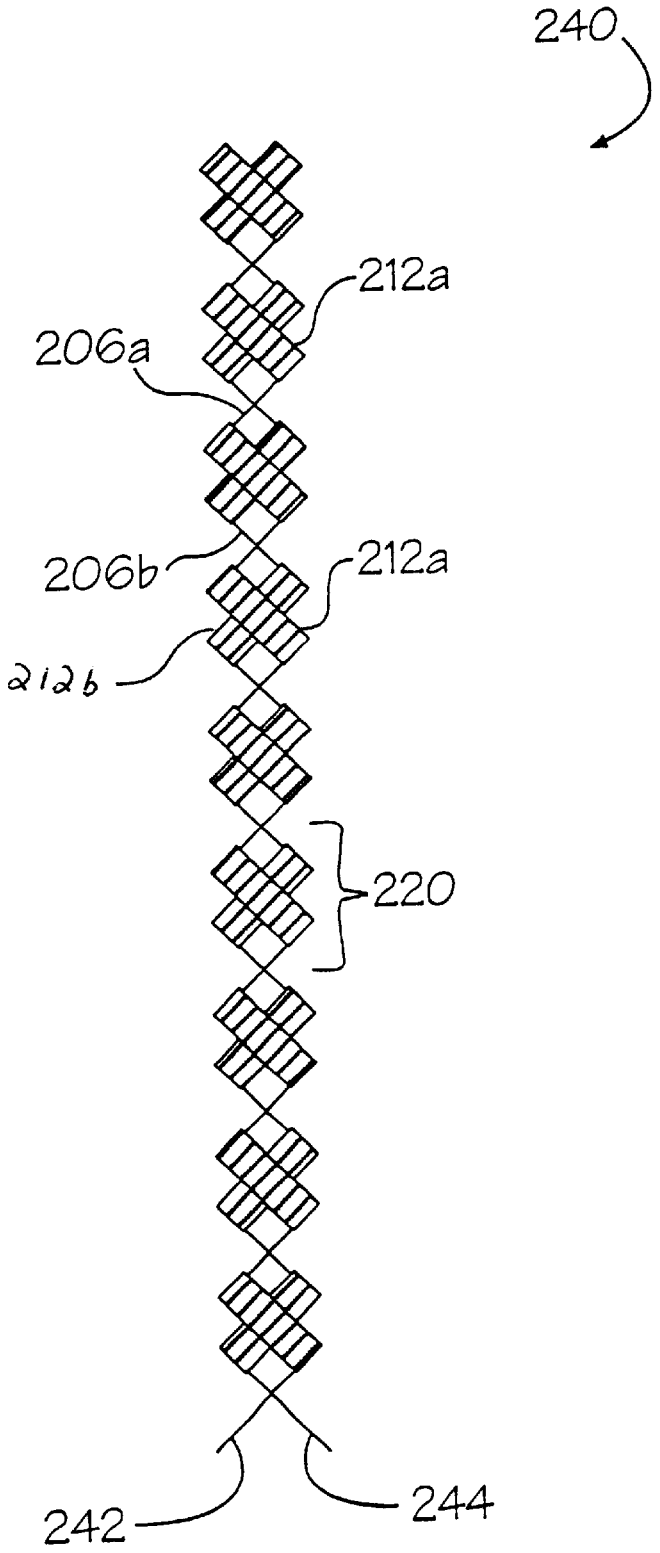
FIG. 6 is a schematic view of a linear array of the crossed MLA elements of FIG. 5.

Referring now to FIG. 6, there is shown a schematic top view diagram of a linear array 240 formed from a series of MLA crossed elements 220 (FIG. 5) also called cells forming the transmission line 240. As illustrated, the multiple orthogonal meander line antennas 220 are interconnected to and by the low impedance lines 206*a*, 206*b*. By properly feeding linear array 240 with an RF signal 242 and 90° phase-shifted RF signal 244, circular polarization of a radiated signal is maintained.

Figure 7:
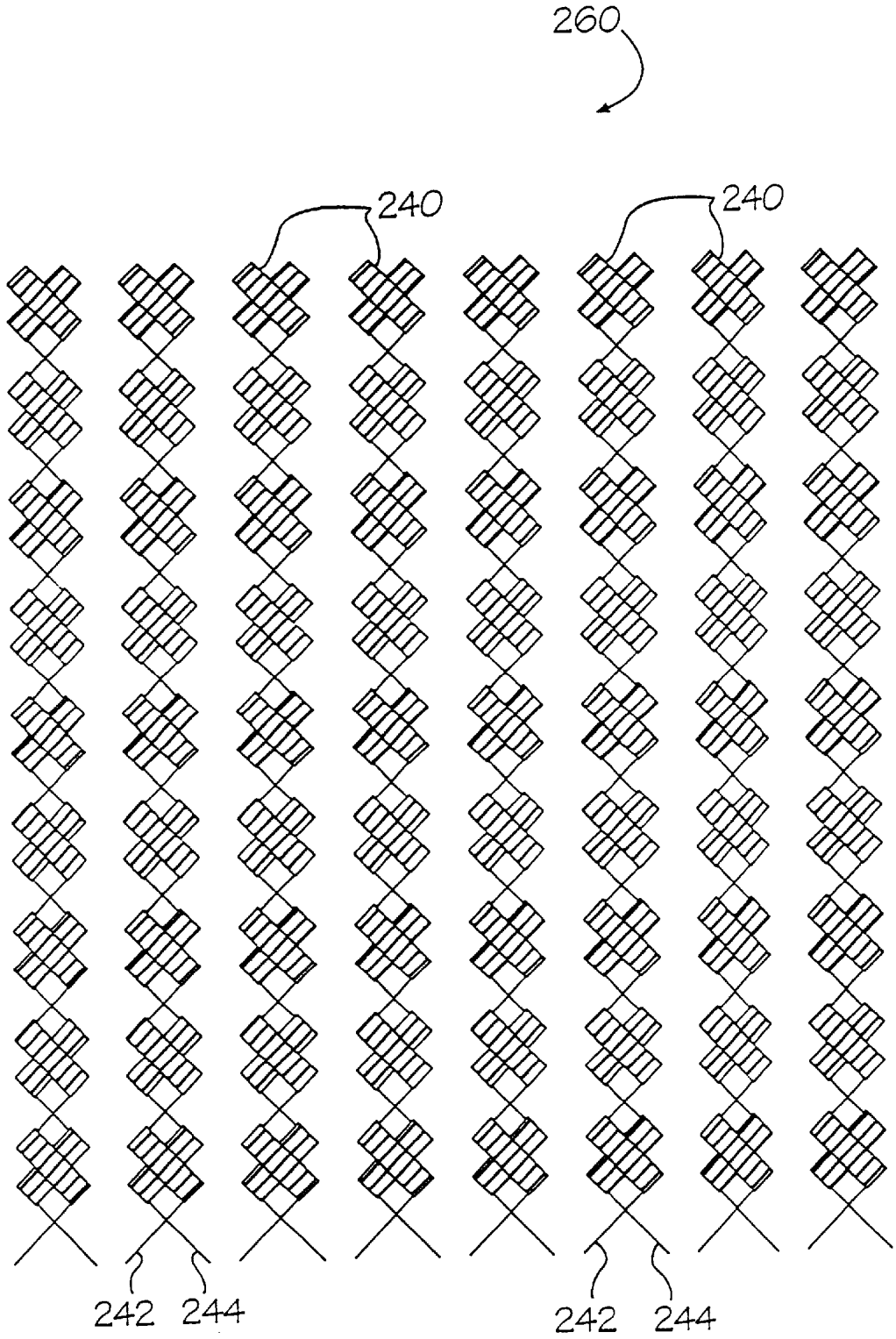
FIG. 7 is a schematic view of a two-dimensional array of the linear arrays of FIG. 6.

Referring now also to FIG. 7, there is shown a schematic representation of a two-dimensional array 260 formed from linear arrays 240. Two-dimensional array 260 allows the antenna to be steered through selective energization of selective linear arrays 240.

By moving the back plate (i.e., the ground plane) 204 relative to meander line 208 (FIG. 4) the antenna formed by two-dimensional array 260 is tuned. By varying spacing d 202 periodically or continuously, the frequency response of antenna 260 may be swept (i.e., scanned). Combining this back plate 204 movement with the selective energization of linear arrays 240, a true scanning, steerable phased-array antenna is formed.

Figure 8:
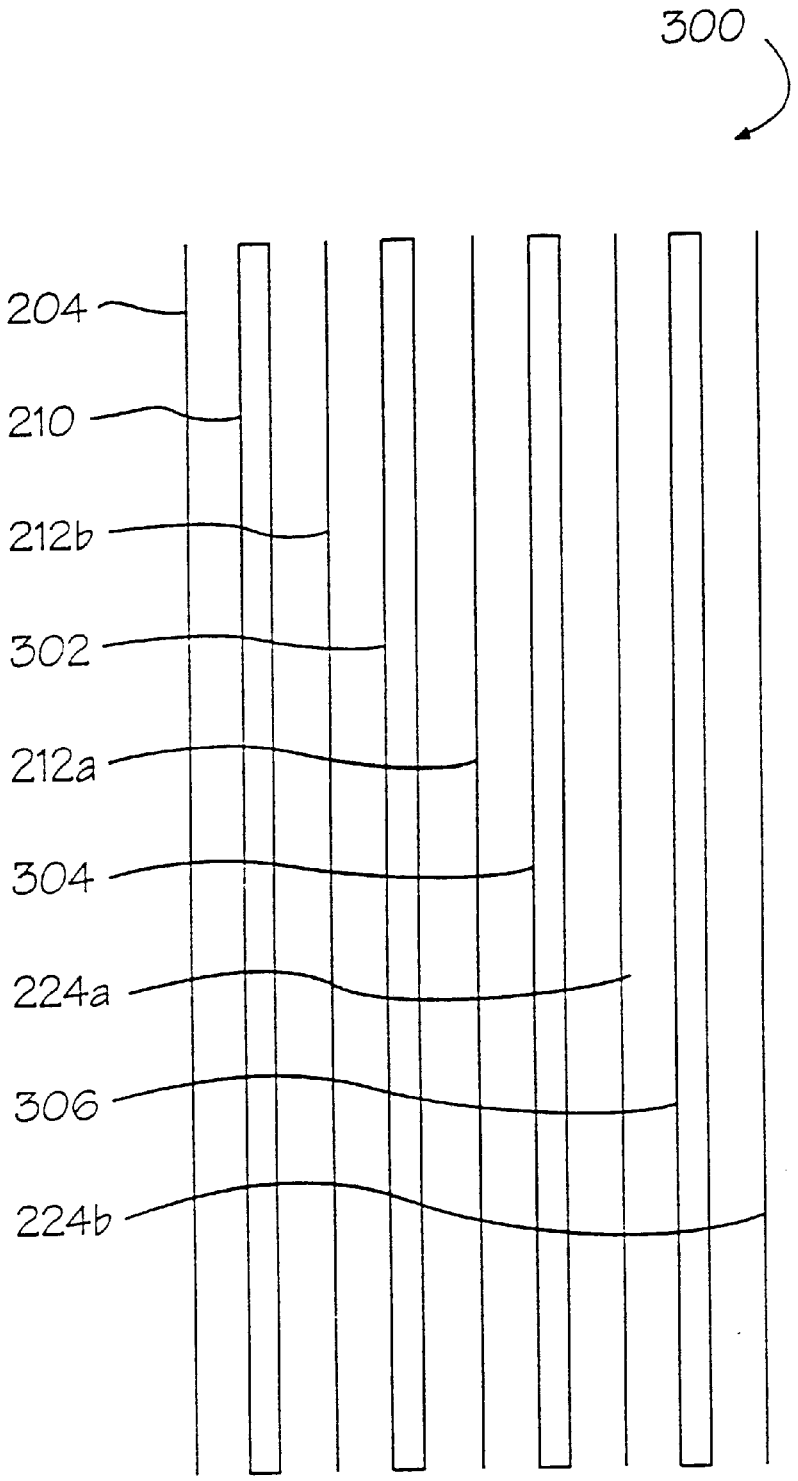
FIG. 8 is a schematic, cross-sectional view of a printed circuit implementation of the inventive antenna.

Referring now to FIG. 8, there is shown a schematic, cross-sectional view of a printed circuit implementation of the antenna of the present invention, generally at reference number 300. Ground plane 204 has a dielectric layer 210 on its upper surface. A low-impedance portion 212*b* of the lower level meander line is then formed on top of dielectric material210. A second dielectric layer 302 is formed over low-impedance portion 212*b*. The low-impedance portion 212a or the upper meander line is formed over dielectric material 302. A first via layer 304, which allows electrical connection to internal planes of the antenna 300, is formed atop and insulated from low impedance portion 212*a*. The lower element radiating surface 224*b* is formed over first via layer 304. Finally, the upper element radiating surface 224*a* is formed over radiating surface 224*b*. The functionality of the printed circuit is the same as described herein.

Figure 9:
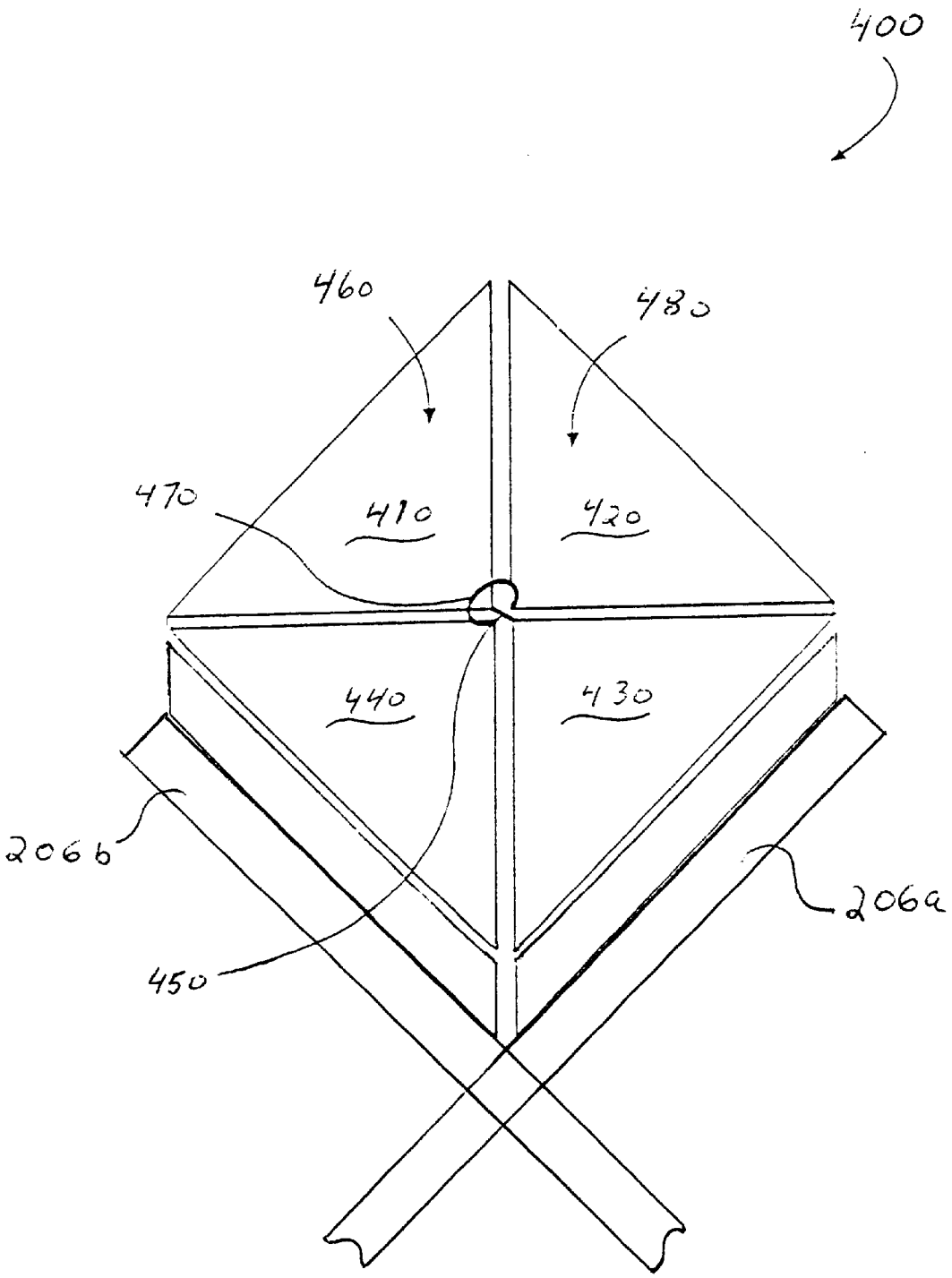
FIG. 9 is a schematic, perspective view of a pair of orthogonal bow-tie meander antenna elements.

Another embodiment of incorporates a bow-tie arrangement as shown in FIG. 9. Pending US Patent Application entitled NARROW-BAND, SYMMETRIC, CROSSED, CIRCULARLY POLARIZED MEANDER LINE LOADED ANTENNA that is herein incorporated by reference.

Referring now to FIG. 9, there is shown a schematic, perspective view of an improved, crossed-element MLA, a bow-tie structure 400. This structure is called a crossed MLA in that it operates as a crossed element antenna. The pair of MLA orthogonal crossed MLA elements 220 (FIG. 5) are replaced by pairs of triangular elements 410,420,430, and 440. Elements 410 and 430 are electrically coupled at point 450, and their interior vertices form a first bow-tie element 126. Likewise, elements 420 and 440 are coupled at point 470 to form a second bow-tie element 480, orthogonal to first bow-tie element 460. Bow-tie elements 460, 480 are each meander line loaded elements. Whereas the orthogonal crossed antenna 220 (FIG. 5), has antenna element crossing over each other there is some cross-coupling, which is reduced by the bow-tie elements 460, 480. In addition, the axial response from the inventive arrangement is improved. To achieve circular polarization, the bow-tie elements 460, 480 are fed in quadrature (i.e., the feeds are 90° out-of-phase) as is well known to those skilled in the antenna design arts. The bow-tie elements represent the high impedance sections.

Each MLA element 460, 480 is connected to a low-impedance section 206*a*, 206*b* corresponding to low-impedance section 206 of meander line 208 (FIG. 4), and the entire structure is disposed above a ground plane (not shown). These low impedance portions of the meander lines 206*a*, 206*b* connect to the next bow-tie element in a linear array. Multiple linear arrays may be arranged to form a square or rectangle as shown herein, as well as other shapes in conformance with the principles of the present invention. The other aspects of the invention recited herein are applicable to the bow-tie arrangement.

Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention. Having thus described the invention, what is desired to be protected by letters patents is presented in the subsequently appended

What is claimed is:

1. A varied impedance transmission line antenna, comprising:

a ground plane;

a transmission line disposed substantially parallel to and in close proximity to said ground plane, wherein said transmission line is a plurality of crossed meander line loaded elements each having an upper element and a lower element;

a first conducting line interconnecting said upper element of each said crossed meander line loaded elements; and a second conducting line interconnecting said lower element of each said crossed meander line loaded elements.

2. The varied impedance transmission line antenna according to claim 1, wherein said crossed meander line loaded elements are connected in series by said first and second conducting line and form an alternating impedance pattern based upon a spacing from said ground plane, wherein said first and second conducting line is a low impedance section and said crossed meander line loaded elements are a high impedance section.

3. The varied impedance transmission line antenna according to claim 2, wherein a propagation constant is varied by changing said spacing.

4. The varied impedance transmission line antenna according to claim 2, wherein said spacing is varied dynamically by moving said ground plane.

5. The varied impedance transmission line antenna according to claim 4, wherein said spacing is varied by means of at least one of the group: stepper motor and piezoelectric actuator.

6. The varied impedance transmission line antenna according to claim 2, wherein said spacing is varied substantially continuously.

7. The varied impedance transmission line antenna according to claim 2, wherein said spacing is varied periodically.

8. The varied impedance transmission line antenna according to claim 1, wherein said first conducting line is connected to a first signal feed and said second conducting line is connected to a second signal feed.

9. The varied impedance transmission line antenna according to claim 8, wherein said first and second signal feed are phase-shifted by 90 degrees.

10. The varied impedance transmission line antenna according to claim 1, further comprising a dielectric material disposed between said plurality of crossed meander line loaded elements and said ground plane and having an adjustable dielectric constant.

11. The varied impedance transmission line antenna according to claim 10, wherein said dielectric material is a ferroelectric material and said dielectric constant is altered by an applied electric field.

12. The varied impedance transmission line antenna according to claim 1, wherein said antenna operates in circular polarization.

13. A varied impedance transmission line antenna, comprising:

a ground plane;

a transmission line disposed substantially parallel to and in close proximity to said ground plane, wherein said transmission line is a plurality of dual bow-tie meander line loaded elements with a first bow-tie element disposed orthogonal to a second bow-tie element;

a first conducting line interconnecting said first bow-tie element of each said dual bow-tie meander line loaded elements; and a second conducting line interconnecting said second bow-tie element of each said dual bow-tie meander line loaded elements.

14. The varied impedance transmission line antenna according to claim 13, wherein said bow-tie meander line loaded elements are connected in series by said first and second conducting line and form an alternating impedance pattern based upon a spacing from said ground plane, wherein said first and second conducting line is a low impedance section and said bow-tie meander line loaded elements are a high impedance section.

15. The varied impedance transmission line antenna according to claim 14, wherein said first conducting line is connected to a first signal feed and said second conducting line is connected to a second signal feed.

16. The varied impedance transmission line antenna according to claim 13, wherein said ground plane is moveable.

17. A varied impedance transmission line antenna array, comprising:

a ground plane;

two or more transmission lines disposed substantially parallel to and in close proximity to said ground plane, wherein said transmission lines are a plurality of crossed meander line loaded elements each having a first element and a second element;

a first conducting line interconnecting said first element of each said crossed meander line loaded elements; and a second conducting line interconnecting said second element of each said crossed meander line loaded elements.

18. The varied impedance transmission line antenna according to claim 17, wherein said one or more transmission lines form a two-dimensional array.

19. The varied impedance transmission line antenna according to claim 17, wherein said first and second signal feed are selectively applied to said plurality of crossed meander line loaded elements, whereby said antenna array is steerable.

20. The varied impedance transmission line antenna according to claim 17, wherein said first and second signal feed are selectively applied to said plurality of crossed meander line loaded elements, whereby an operating frequency of said antenna array is scannable.

* * * * *